US009517400B2

(12) United States Patent
Akervall et al.

(10) Patent No.: US 9,517,400 B2
(45) Date of Patent: Dec. 13, 2016

(54) CUSTOM-FORMABLE MOUTH GUARD AND METHOD OF FABRICATION

(75) Inventors: Jan Akervall, Ann Arbor, MI (US); Johann Schwank, Ann Arbor, MI (US)

(73) Assignee: Akervall Technologies, Inc., Saline, MI (US)

( * ) Notice: Subject to any disclaimer, the term of this patent is extended or adjusted under 35 U.S.C. 154(b) by 607 days.

(21) Appl. No.: 12/228,179

(22) Filed: Aug. 11, 2008

(65) Prior Publication Data

US 2009/0038624 A1 Feb. 12, 2009

Related U.S. Application Data

(60) Provisional application No. 60/954,882, filed on Aug. 9, 2007.

(51) Int. Cl.
*A61C 5/14* (2006.01)
*A63B 71/08* (2006.01)

(52) U.S. Cl.
CPC ..... *A63B 71/085* (2013.01)

(58) Field of Classification Search
CPC ..... A63B 71/085; A63B 2071/086; A63B 2071/088; A63B 71/08
USPC ..... 128/859, 861, 862
See application file for complete search history.

(56) References Cited

U.S. PATENT DOCUMENTS 4,718,662 A 1/1988 North
4,955,393 A 9/1990 Adell
5,051,476 A 9/1991 Uji et al.
5,082,007 A 1/1992 Adell
5,165,423 A 11/1992 Fowler et al.
5,293,880 A 3/1994 Levitt
5,313,960 A * 5/1994 Tomasi ..... 128/848
5,692,523 A * 12/1997 Croll et al. ..... 128/859
6,036,487 A * 3/2000 Westerman ..... 433/6
6,080,923 A * 6/2000 Austin ..... 84/383 R
6,109,266 A * 8/2000 Turchetti ..... 128/861
6,295,988 B1 * 10/2001 Sue ..... 128/859
7,404,403 B2 7/2008 Farrell
2004/0112389 A1 6/2004 Abraham
2005/0034733 A1 * 2/2005 Liddle et al. ..... 128/859
2007/0084472 A1 4/2007 Berghash
2007/0151568 A1 * 7/2007 Maurello ..... 128/859
(Continued)

FOREIGN PATENT DOCUMENTS

JP 08206272 8/1996
JP 2005342133 12/2005

*Primary Examiner* — Victoria J Hicks
(74) *Attorney, Agent, or Firm* — Marshall & Melhorn, LLC

(57) ABSTRACT

A mouth guard composed of a polymer consisting essentially of polycaprolactone exhibits a low softening point, enabling it to be easily custom-fitted by the user or a health professional. The material is provided in the form of a generally U-shaped, unformed sheet of material, enabling the material to be heated with hot water or microwave energy and custom-fitted to the dentition of a user. The mouth guard may be perforated and may include a no-stick layer and/or a flavoring agent. A plurality of mouth guards may be provided in different sizes for children and adults and different shapes for different sports. In the preferred embodiments the mouth guard has a periphery including a plurality of lobes and cusps to enhance fitting. A method of fabricating an improved mouth guard according to the invention is also disclosed.

24 Claims, 1 Drawing Sheet

(56) References Cited

U.S. PATENT DOCUMENTS

| | | | |
|---|---|---|---|
| 2008/0289639 | A1 | 11/2008 | Bancroft |
| 2009/0114232 | A1 | 5/2009 | Landi et al. |
| 2009/0223526 | A1 | 9/2009 | Berghash et al. |
| 2010/0051038 | A1 | 3/2010 | Quigless |

* cited by examiner

CUSTOM-FORMABLE MOUTH GUARD AND METHOD OF FABRICATION

REFERENCE TO RELATED APPLICATION

This application claims priority from U.S. Provisional Patent Application Ser. No. 60/954,882, filed Aug. 9, 2007, the entire content of which is incorporated herein by reference.

FIELD OF THE INVENTION

The present invention relates generally to mouth guards and, specifically, to improved, custom-fittable materials with optimized shapes and perforations to maximize the protection of teeth.

BACKGROUND OF THE INVENTION

Commercially available mouth guards are pre-fitted, and come in standardized shapes and sizes. Professional athletes participating in contact sports such as football routinely wear custom fitted mouth guards, and they have a relatively lower incidence rate of dental injuries. However, in other sports such as basketball, the wearing of mouth guards is not widely practiced, and the incidence rate is much higher, with 34 percent of all basketball injuries falling into the category of dental injuries. One of the reasons of poor compliance with mouth guard protection is that many commercially available mouth guards are uncomfortable to wear. They tend to be bulky, making it difficult to talk and breath while participating in sports activities.

Dental injuries, including fracture and loss of teeth, are the most common orofacial injuries occurring in many sports despite the use of commercially available mouth guards. This indicates insufficient protection from currently used products. An ideal mouth guard would have excellent fit and retention, must be comfortable to wear, allow the wearer to speak and breathe without hindrance, but be tear resistant, resilient, and protective.

The term "mouth guard" refers to a wide range of products. The American Society for Testing and Materials has issued ASTM Designation: F697-80, (1992), providing a standard practice for care and use of mouth guards. ASTM has classified mouth guards into stock mouth guards, mouth-formed mouth guards, and custom-fabricated mouth guards.

Approximately 90 percent of mouth guards are sold in sporting goods stores. The least expensive and also least effective type of mouth guard is the stock mouth guard. These mouth guards come in limited sizes, and lack retention. To be held in place, the wearer must constantly bit down on them. These types of mouth guards hinder verbal communication and interfere with breathing, and tend to be uncomfortable and bulky. Often, users cut them to make them more comfortable, but this reduces the protective function.

The second type of mouth guard falls into the category of "boil & bite" mouth guards. These are the most widely used mouth guards. They contain a thermoplastic material, almost exclusively ethyl vinyl acetate (EVA) that can be softened by immersion into boiling water, and then formed by pressing the softened material over the teeth with fingers, followed by biting down on the softened material until it hardens while it cools down. There has been some concern voiced by dentists that these types of mouth guards often lack proper extensions and fail to cover all the posterior teeth. As with stock mouth guards, athletes are tempted to cut and reshape these mouth guards in attempts to make them more comfortable, as they have poor fit, limited retention, and in some cases trigger the gag reflex. According to Dr. Joon Park (First International Symposium on Biomaterials, August 1993) boil and bite mouth guards suffer a drastic decrease in occlusal thickness during the molding process, eliminating a significant portion of the protective properties of the mouth guard and giving the wearer a false sense of protection.

Only about 10 percent of all mouth guards in use today are custom fitted by dental professionals. For so-called vacuum mouth guards, the dentist first takes an impression of the patient's teeth, and a stone cast of the maxillary, upper, arch is fabricated. Then, a thermoplastic material, usually a polyethylene vinyl acetate copolymer (EVA) is molded over the stone cast while applying a vacuum. The resulting mouth guard is then trimmed and polished. Alternatively, multiple layers of polymer are laminated together under pressure in an attempt to improve the physical properties of the protective layers.

These custom-made mouth guards tend to be very expensive, and require a visit to the dentist, and, in some cases, fabrication in a dental laboratory. The expense and complexity of getting a custom fitted mouth guard has hindered customer acceptance, and most custom fitted mouth guards are purchased by professional athletes, but have not penetrated the general consumer market. In an experimental series at University of Michigan Dental School, acrylic resins have been used to increase the tensile strength for mouth guards for ice hockey players. Protection for significant impact, e.g. from a direct hit of a hockey puck or hockey stick, has increased, but the prize for these mouth guards is significantly higher than for a regular EVA based custom made mouth guard, and the mouth guard got significantly thicker and therefore uncomfortable. However, the principle of using a hard material, e.g. acrylic resins, in contrast to a soft material, e.g. EVA, appeared to be better from a teeth protective standpoint.

Typical impact energy absorbing a materials used for protective athletic gear are open or closed cell foams of various thermoplastic polymers including polyurethane, polyethylene, polystyrene, as well as foams or dense bodies of elastomeric polymers, including silicones, ethylene vinyl acetate (EVA), ethylene-propylene rubbers (EPM), ethylene-propylene-diene rubbers (EPDM). In addition to single component materials, various composite materials have been reported. Many of these materials contain mixtures of polyethylene with fibers (U.S. Pat. No. 4,946,721, issued Aug. 7, 1990). Other approaches include composites of rigid hollow spheres encapsulated in an elastomeric matrix (U.S. Pat. No. 4,101,704, issued Jul. 18, 1978), or composites of elastomers with fillers (U.S. Pat. No. 4,082,888, issued Apr. 4, 1978).

There have also been attempts to improve the impact energy absorption capacity of materials by laminating different layers together. For example, European Patent EP 0 955 211 B1, issued Jan. 28, 2004, teaches impact energy absorbing materials for protective athletic gear, including mouth guards, using layers of expanded polytetrafluoroethylene (ePTFE) and at least one layer of an elastomer.

U.S. Pat. No. 5,051,476 (Sep. 24, 1991) resides in an improved mouth guard composition comprising and ethylene/vinyl acetate copolymer with 4-50 percent of a thermoplastic polycaprolactone, optionally with polyvinyl acetate, colorants, and perfumes. However, due to the large EVA content, these mouth guards do not take full advantage of the superior materials properties of polycaprolactone.

Polycaprolactone mixed with a thermoplastic rubber material has a softening point of 50-70° C., and has been used as orthopedic splinting or casting material (U.S. Pat. No. 4,661,535, Micale J. Borroff, Donald A. Willstead, Apr. 28, 1987). The filler added to polycaprolactone can also be a mixture of talc, and calcium silicate.

Polycaprolactone has also been used as scaffolding material for bone tissue engineering (Jessica M. Williams, Adebisi Adewunmi, Rachel M. Schek, Colleen L. Flanagan, Paul H. Krebsbach, Stephen E. Feinberg, Scott J. Hollister, and Suman Das, "Bone tissue engineering using polycaprolactone scaffolds fabricated via selective laser sintering", Biomaterials 26 (2005) 4817-4827). The solid free form fabrication technique employed allows precise control over pore size, permeability, and stiffness.

U.S. Pat. No. 5,339,832 discloses a thermoplastic boil & bite type mouth guard that has an integrated shock absorbing framework. This mouth guard is a composite made from a thermoplastic material and a low compression elastomer framework embedded in the U-shaped portion of the mouth guard. The shock-absorbing insert is intended to attenuate and dissipate forces acting on the mouth guard.

In U.S. Pat. No. 5,293,880, an athletic mouth guard is reported that is based on a unitary structure comprising a mouthpiece and an elongated strap adapted for attachment to face masks of helmets. The mouthpiece has walls of different thicknesses in different regions so that the forces of an upwardly directed blow are transmitted more to the posterior teeth than the anterior teeth.

U.S. Pat. No. 5,746,221, issued May 5, 1998, relates to a cold-formable thermoplastic mouth guard material that has a very low softening point, making it possible for the user to custom-fit the mouth guard without requiring the services of a dentist. The mouth guard comprises a U-shaped structure comprising an expanded PTFE material that can be shaped at room temperature. The patent also discloses one coating on at least a portion of the surface of the mouth guard. The user places the mouth guard into the mouth and bites down to retain the contours of the teeth. The mouth guard's energy absorption capacity has been tested according to ASTM D1054-91, Standard Test for Rubber Property Resilience Using a Rebound Pendulum. These tests indicate that the expanded PTFE materials absorb about 75 percent of the impact energy, while conventional mouth guards absorb only about 50-65 percent of the energy. This patent also mentions the use of one or more fillers, in direct reference to U.S. Pat. No. 4,985,296 that teaches the formation of expanded PTFE materials with fillers incorporated therein.

U.S. Pat. No. 5,746,221 teaches the use of fillers to enhance the appearance of a mouth guard by adding color, sparkles, patterns, and textures. One or more fillers can also be included to increase the strength, resilience, texture, or stiffness of the materials. According to this patent, fillers may be added which provide desirable flavors to the mouth guard. The patent states that "it is believed that energy is spread and transferred via the resilient outer region to the interconnected node and fibril structure of the expanded PTFE which absorbs the energy. The strength of the fibrils and their random interconnectedness absorbs the impact by spreading it out to a wider area." However, the very fact that this mouth guard material is deformable at room temperature by simply biting on it will affect its long term durability, and the relative softness of the material will permit the transmission of forces to the teeth upon high-speed impact of an object.

U.S. Pat. No. 6,491,521 (Dec. 10, 2002) teaches a mouth guard with teeth fashioned from a group of materials, including plastic, plastic composite, rubber, and rubber composite that become formable when heated above normal body temperature of 98.6° F. This mouth guard is pliable and hardens at or below this temperature. The primary purpose of the invention is to solve the need for a mouth guard capable of intimidating opponents in sports by adding the appearance of teeth to the mouth guard. This patent builds upon a number of prior patents, for example U.S. Pat. No. 3,987,546, teaching the method of making a prosthetic denture that includes an assembly of hard acrylic teeth bonded to a semi hard acrylic polymer blend, U.S. Pat. No. 5,951,291 deals with a cosmetic accessory device for teeth that simulates the appearance of teeth and gum.

U.S. Pat. No. 6,491,036 (Dec. 10, 2002) teaches a customizable low-density polyethylene mouth guard with a nucleating agent permitting the softened mouth guard to shrink onto the teeth and guns for a tight fit, and to impart gloss and clarity to the appliance. This patent also teaches the incorporation of antimicrobial agents.

SUMMARY OF THE INVENTION

The invention is directed to mouth guards composed of a thermoplastic material composition with a low softening point, enabling it to be easily custom-fitted by the user or a health professional. The material provides superior protection to teeth during athletic and military activities, medical procedures and applications in dentistry due to the properties and optimized shape of the mouth guard material.

In the preferred embodiments, the material is provided in the form of a generally U-shaped, flat piece of material composed of a polymer consisting essentially of polycaprolactone, enabling the material to be heated with hot water or microwave energy and custom-fitted to the dentition of a user. The material has a thickness in the range of 1-5 mm, more preferably on the order of 1.6 mm.

In the preferred embodiments the material is perforated, with the majority of the perforations being disposed primarily outside of an arc-shaped region associated with a user's bite line. The material may include a no-stick layer, at least in the regions of contact to a user's dentition, and a flavoring agent which may be embedded into the material. A plurality of mouth guards may be provided in different sizes for children and adults as well as for different sports. In the preferred embodiments the material sheet has a periphery including a plurality of lobes and cusps to enhance fitting.

A method of fabricating an improved mouth guard according to the invention comprises the steps of providing an unformed piece of material composed of a polymer consisting essentially of polycaprolactone, heating the unformed, pre-cut piece so that it becomes soft and pliable, and custom-fitting the soft and pliable mouth guard to the dentition of a user. The mouth guard is heated to about 46-50° C. by immersion in hot water or other hot liquids, until the material becomes transparent, or it may be heated with microwave energy. The mouth guard may be re-heated and re-formed as desired.

DETAILED DESCRIPTION OF THE INVENTION

Figure 2:
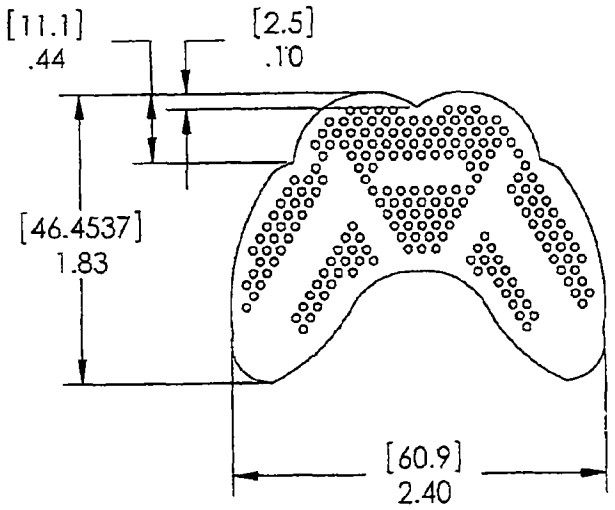
FIG. 2 shows an example of one embodiment of a child mouth guard according to this invention. The dimensions and shapes of the mouth guard piece, and the number, diameter, and location of the perforations of the material can vary to optimize the mouth guard for specific applications.

The current paradigm for mouth guards is to use pliable, relatively soft materials such as EVA. The conventional wisdom is that soft materials should be able to cushion the teeth against impact. This invention recognizes that this "cushioning" approach is conceptually flawed, and instead uses a material that has higher tensile strength and is less prone to deformation than EVA, thus providing superior protection of teeth. Physics teaches that during an inelastic collision, a mouth guard struck by a fast moving object such as a baseball or hockey puck or stick will absorb most, if not all, of the force of collision through vibrations induced in the mouth guard material, converting the kinetic energy of the fast moving object upon impact into heat and sound energy. However, this energy conversion does not occur instantaneously, and a high velocity collision does not always give enough time for the material to undergo the vibrations that lead to conversion of the kinetic energy into heat and sound. This is especially problematic with soft materials such as EVA mouth guards that will therefore transfer more of the impact forces to the teeth. Even if the impact is not strong enough to rupture the EVA mouth guard, the softness of the material will permit severe, local deformations in the line of impact, and exert strong localized forces on the underlying teeth.

The present invention provides shock absorption through material composition in conjunction with strategically placed perforations in the material. Multi physics computer models have shown that the diameters and shapes of the perforations change upon impact. In comparing perforated and unperforated polycaprolactone samples with EVA, we noted that the perforated polycaprolactone samples had absorbed energy via compression of the material in lateral directions, rather than transmitting the energy through the material, as was the case with unperforated polycaprolactone and to a larger extent EVA. This internal deformation in lateral directions is a major component in the shock absorbing properties of the current invention, thus decreasing the remaining forces that can be transmitted to the teeth.

Mouth guards according to this invention are made from a material that is harder and tougher than EVA-containing mouth guards. As such these novel mouth guards are better able to convert the kinetic energy of a fast moving object into heat and sound and lateral deformation of the perforations, thereby lessening the remaining forces transmitted to the teeth. The higher tensile strength of the material lessens the deformation and distributes the forces more evenly.

In the preferred embodiments mouth guards according to the invention are based on a polycaprolactone containing polymer. The mouth guard may be coated with a "no stick" layer and/or, optionally, a flavoring agent. The mouth guard becomes completely soft in seconds when heated in water or in a microwave oven at temperatures of 46-50° C., allowing it to easily be fitted to an ideal shape by the user, a parent, a coach, a dentist, or other health professional without creating discomfort due to high fitting temperatures, as is the case for EVA based mouth guards.

Figure 1:
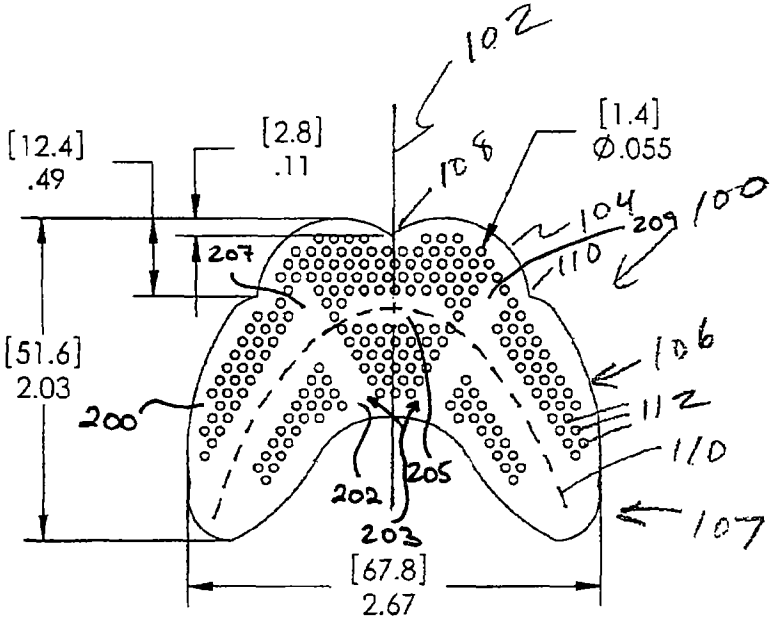
FIG. 1 shows an example of one embodiment of an adult mouth guard according to this invention.

FIG. 1 shows an example of an adult mouth guard according to this invention with preferred dimensions, and FIG. 2 shows an example of a child mouth guard with preferred dimensions. Referring to FIG. 1 with the understanding that the same descriptions apply to FIG. 2, the guard is provided as an unformed mouth guard 100 having a thickness on the order of 1-5 mm, more preferably on the order of 1.6 mm.

Mouth guards according to the invention are generally U-shaped and substantially symmetrical about a centerline 102. The mouth guard is perforated, particularly in areas where the greatest deformation takes place during the molding process. Significantly fewer perforations are present along the bite line 110 associated with a user's upper teeth and in areas 111 above the gum line. The purpose of the perforations is shock absorption and to improve comfort, i.e. improve drinking and decrease drooling. The present invention can be used on upper as well as lower teeth. The latter is important in many sports, e.g. ice hockey, since studies have shown that dental injuries of the lower teeth is common even if the upper teeth are protected by a mouth guard.

As can be appreciated from FIG. 1, the arc-shaped bite line 110 divides the sheet into a first area of material 200 entirely on one side of the arc-shaped bite line 110 and a second area of material 202 entirely on the other side of the arc-shaped bite line 110. The first and second areas 200, 202 each have a plurality of closely spaced perforations which penetrate entirely through the sheet. The first and second areas 200, 202 have an unequal number of perforations. Further, the perforations in the first area of material 200 are not symmetrical with the perforations across the bite line 110 in the second area of material 202. The perforations number at least 20 perforations that are all of the same size and shape.

An unperforated V-shaped area of material 203 extends across the bite line 110 from the first area 200 to the second area 202. The area 203 opens toward the cusp area 108. Thus, the area 203 is widest in the first area 200 and narrowest in the second area 202. As a result, the V-shaped area of material 203 bounds more perforations in the first area 200 than the second area 202.

The V-shaped area of material 203 extends to a rear gum line 111 in the second area 202. The V-shaped area of material 203 extends into the first area 200, but it is blocked from a forward gum line 111 by perforations. More particularly, one leg 207 of the V-shaped area 203 is blocked by more perforations than another leg 209 of the V-shaped area 203.

At least four rows of perforations are located in the first area 200 between the bite line 110 and the cusp area 108. And, at least four rows of perforations are located in the second area 202 between the bite line 110 and the rear gum line 111.

A first row of perforations in the first area 200 directly adjacent the cusp area 108 has three perforations on one side of the centerline 102 and four perforations on the other side of the centerline 102.

An unperforated area of material 205 is between the first and second areas 200, 202, and within the V-shaped area 203 and the arc-shaped bite line 110, to located at least one dentition therein.

The centerline 102 extends through the perforations, through the unperforated area of material 205 for the at least one dentition, and through the arc-shaped bite line 110 to divide the sheet in half. An unequal number of perforations are located on one half of the centerline 102 compared with the other half.

Although the mouth guard may have a smooth and continuous outer perimeter, in the preferred embodiment a series of lobes and cusps are used to enhanced the molding process. Again referring to FIG. 1, one such cusp 108 is provided between the right and left halves on centerline 102.

Another cusp 118 is preferably provided between the incisors and the molars, with a lobe 104 formed between points 108 and 110. A second lobe 106 is preferably present between point 110 and portion 107 which covers the back molars.

The cusp areas 108 and 110 facilitate the fitting and prevent the material to fold when the soft material is molded up against the gum line. It allows the material to mold around the uneven surface of the dental roots where they are inserted into the bone. Furthermore, these cusp areas have been proven in our studies to facilitate the absorption of energy, i.e. acting similar to crumple zones in automobiles. These zones absorb some of the energy and since they are located up against the jaw bone rather than over the teeth, the increase the teeth protection.

The unperforated V-shaped areas in the material help to prevent the softened material from folding and act as guide for where to place the front teeth during the fitting process. Multi physics computer models show that impact applied to the unperforated areas results in some of the energy being transmitted to the adjacent perforated areas where the energy gets absorbed.

Due to the ease with which the material can be formed and manipulated, the user can fit the mouth guard on site or at home without assistance. Fitting is superior due to the distinct properties of the polymer (thin and pliable at moderate temperatures). This permits the user to place and fit the heated, soft material over the dentition through a rapid process involving sucking the material onto the teeth. Thanks to the perforations in the mouth guard, this suction creates a minimal dead space between the material and the teeth, thus leading to near perfect, conformal fit. This, in turn, improves compliance and makes the fit more comfortable. Studies have shown that if a mouth guard is uncomfortable the user will frequently take it out and sometimes not wearing it. Subsequently, the superior fit and improved comfort from the present invention is of great importance for the protection against dental injuries.

Polymer-based mouth guards according to this invention are inexpensive, biocompatible and disposable, the latter improving oral hygiene. Users can move their jaws in any way without risking fall out, and the mouth guard can be re-shaped to optimize fitting multiple times. Users can drink and even eat without removing the mouth guard, which improves compliance. Except for minimal lisping in some cases, speech is basically normal, which is a major advantage over bulky conventional mouth guards. The superior fitting also results in that less material is needed on the inside, which in turn reduces gagging and improves speech.

Users of the inventive mouth guard can breathe more easily, since there is no need to bite down on the guard thanks to its superior fitting. There is more room in the mouth since it is thinner and more pliable, which improves speech. The mouth guard also works with braces and significantly uneven teeth, since it adjusts to any shape and surface of the dentition or braces. Children with braces cannot generally wear the currently used mouth guards. Salivation is reduced since the appliance is thinner and perforated. The product does not deform from chewing, and the optional flavoring makes it more pleasant to use.

We claim:

1. An improved mouth guard, comprising:

a sheet of material composed of a thermoplastic polymer, enabling the sheet to be heated with hot water or microwave energy;

the sheet having an arc-shaped bite line, the arc-shaped bite line divides the sheet into a first area of material entirely on one side of the arc-shaped bite line and a second area of material entirely on another side of the arc-shaped bite line, wherein the first and second areas each have a plurality of closely spaced perforations which penetrate entirely through the sheet, wherein said perforations laterally deform with an impact;

a first unperforated V-shaped area of material located across said arc-shaped bite line to bound a greater number of perforations in said first area than said second area; and a second unperforated area of material between said first and second areas and within said V-shaped area and said arc-shaped bite line.

2. The improved mouth guard of claim 1, wherein said unperforated V-shaped area is located through said bite line.

3. The improved mouth guard of claim 2, wherein said unperforated V-shaped area is widest in said first area and narrowest in said second area so that more perforations are bounded in said first area than said second area.

4. The improved mouth guard of claim 2, wherein said unperforated V-shaped area extends to a rear gum line but is blocked from a forward gum line by some of said perforations, wherein one leg of said V-shaped area is blocked by more perforations than another leg of said V-shaped area.

5. The improved mouth guard of claim 1, wherein there are fewer perforations above a gum line of said sheet than below said gum line.

6. The improved mouth guard of claim 5, wherein a plurality of rows of perforations are located in said first area between said arc-shaped bite line and a cusp area and a plurality of rows of perforations are located in said second area between said arc-shaped bite line and said gum line.

7. The improved mouth guard of claim 1, wherein the sheet of material has a thickness in the range of 1-5 mm.

8. The improved mouth guard of claim 1, wherein the mouth guard further includes a no-stick layer.

9. The improved mouth guard of claim 1, further including a flavoring agent.

10. The improved mouth guard of claim 1, including a plurality of material sheets provided in different sizes for children and adults and different sports.

11. The improved mouth guard of claim 1, wherein the sheet of material has a periphery including a plurality of lobes and cusps to enhance fitting and impact force dissipation.

12. The improved mouth guard of claim 1, wherein the thermoplastic polymer is polycaprolactone.

13. The improved mouth guard of claim 1, wherein the unfitted sheet has a thickness on the order of 1-5 mm.

14. The improved mouth guard of claim 1, wherein the unfitted sheet has a thickness on the order of 1.6 mm.

15. The improved mouth guard of claim 1, wherein the unfitted sheet of material is thin and substantially flat prior to heating and fitting.

16. The improved mouth guard of claim 1, wherein said lateral deformation of said perforations comprises shape and diameter changes of said perforations.

17. The improved mouth guard of claim 1, wherein there are fewer perforations in said bite line compared with said areas on said sides of said bite line.

18. A method of fabricating an improved mouth guard, comprising:

providing an unfitted sheet of material composed of a thermoplastic polymer enabling the sheet to be heated with hot water or microwave energy, the sheet having an arc-shaped bite line, wherein the arc-shaped bite line has a first area of material entirely on one side of the arc-shaped bite line and a second area of material entirely on another side of the arc-shaped bite line, locating a plurality of closely spaced perforations which penetrate entirely through the sheet in both the first and second areas, wherein said perforations laterally deform with an impact, and providing a first unperforated V-shaped area of material across said arc-shaped bite line to bound a greater number of perforations in said first area than said second area, providing a second unperforated area of material between said first and second areas and within said V-shaped area and said arc-shaped bite line;

heating the sheet so that the material becomes soft and pliable; and allowing the material to harden in a custom-fitted shape.

19. The method of claim 18, wherein the material is heated by immersion in hot water or other hot liquids.

20. The method of claim 18, wherein the material is heated with microwave energy.

21. The method of claim 18, further including the step of re-heating and re-forming the material if needed.

22. An improved mouth guard, comprising:

a sheet of material having an arc-shaped bite line, said arc-shaped bite line divides the sheet into a first area of material entirely on one side of the arc-shaped bite line and a second area of material entirely on another side of the arc-shaped bite line, wherein the first and second areas each have a plurality of closely spaced perforations which penetrate entirely through the sheet, wherein an unperforated V-shaped area of material extends from said first area, across said bite line and into said second area, wherein said unperforated V-shaped area is widest in said first area and narrowest in said second area to bound a greater number of perforations in said first area compared with said second area, an imaginary centerline of said sheet of material extending through said arc-shaped bite line to divide said sheet, and said unperforated V-shaped area, in half, wherein an unequal number of perforations are located on one half of said imaginary centerline compared with the other half.

23. The improved mouth guard of claim 22, wherein a first row of perforations in said first area directly adjacent a cusp area has three perforations on one side of said centerline and four perforations on the other side of said centerline.

24. An improved mouth guard, comprising:

a sheet of material having an arc-shaped bite line, and a plurality of closely spaced perforations which penetrate entirely through the sheet, wherein said perforations laterally deform with an impact, an unperforated V-shaped area of material between said perforations on said arc-shaped bite line, an imaginary centerline of said sheet of material extending through said perforations, through said unperforated V-shaped area of material, and through said arc-shaped bite line to divide said sheet in half, wherein an unequal number of perforations are located on one half of said imaginary centerline compared with the other half.

* * * * *